United States Patent [19]

Ailey, Jr.

[11] 4,393,627

[45] Jul. 19, 1983

[54] REVERSING SCREW/HIGH-LOW SPEED LEVEL WIND SCREW

[75] Inventor: Harrison A. Ailey, Jr., Knoxville, Tenn.

[73] Assignee: Acraloc Corporation, Oak Ridge, Tenn.

[21] Appl. No.: 236,791

[22] Filed: Feb. 23, 1981

[51] Int. Cl.[3] ..... B24B 19/00; B24B 3/00

[52] U.S. Cl. ..... 51/246; 51/249; 51/253; 51/140; 51/40; 51/77 BS; 74/58; 408/137

[58] Field of Search ..... 51/246, 249, 253, 140, 51/40, 165.8, 77 BS, 34 E; 114/144 E, 144 R, 155, 157, 159; 82/5, 27; 408/129, 137; 409/76, 77; 180/146, 147; 74/58, 59, 127, 424.8 R; 145/53, 54; 142/47; 244/53; 440/58-60

[56] References Cited

U.S. PATENT DOCUMENTS

| | | | |
|---|---|---|---|
| 700,970 | 5/1902 | McFarland, Jr. | 74/127 |
| 3,233,371 | 2/1966 | Stucker | 51/249 |
| 3,481,249 | 12/1969 | Holloway | 409/77 X |
| 3,779,094 | 12/1973 | La Barre | 74/424.8 R |
| 4,061,049 | 12/1977 | Beurrier | 74/424.8 R |

*Primary Examiner*—James G. Smith
*Assistant Examiner*—Debra S. Meislin
*Attorney, Agent, or Firm*—Pitts, Ruderman & Kesterson

[57] ABSTRACT

Sharpening mechanism for moving at a variable speed along the length of the sharp edge of a reciprocating knife used in cloth cutting machines is disclosed. The apparatus includes a driven grinding apparatus (26) such as is known in the art for contacting an edge of a reciprocating knife (24). Driven grinding apparatus (26) is moved by a tubular carrier member (44) which moves the grinding mechanism (26) along the edge of reciprocating knife (24) in a manner also known in the art. A traverse mechanism for moving the carriage along the knife edge includes a guide mechanism (52) attached to tubular member (44) for following left and right hand peripheral threads (34) cut in the drive shaft (32). To achieve the variable speed, the peripheral left and right hand threads (34) cut in drive shaft (32) have a first pitch at an uppermost portion (56) and a pitch different from the first pitch in a lowermost portion (54) such that the traverse speed of the grinding mechanism (26) varies at selected portions of the reciprocating blade. In a preferred embodiment, the uppermost peripheral threads (34) have a higher pitch than the lowermost peripheral threads such that additional contact time is available for the grinding apparatus (26) at the lower tip of the reciprocating blade (24).

9 Claims, 4 Drawing Figures

REVERSING SCREW/HIGH-LOW SPEED LEVEL WIND SCREW

DESCRIPTION

Technical Field

This invention relates generally to automatic knife sharpening devices, and more particularly to automatic knife sharpening devices for use with the reciprocating knife of a cloth cutting machine. The knife sharpening apparatus is built as part of the cloth cutting machine such that whenever the blade becomes dull, the knife sharpening apparatus can be engaged to traverse the full length of the reciprocating blade and thereby sharpen the blade.

Background Art

There are various types of commercial cutting machines used for cutting cloth and other sheet material. Such machines typically comprise a vertical reciprocating knife having a substantially vertical cutting edge which is directed to follow a design pattern or line to cut a lay of cloth or other sheet material by moving and guiding the machine about on a table supporting the material. Various types of apparatus are employed for sharpening the reciprocating knife blade of such cloth cutting machines. Some of these sharpening devices employ fixing grinding wheels which only rotate when in contact with the reciprocating knife blade. Others use simultaneously rotating wheels on opposite sides of the knife; whereas still other use two flexible bands for sharpening the knife blade. For example, referring to U.S. Pat. No. 2,537,208 issued to F. G. Clark on Jan. 9, 1951 there is shown a knife sharpening device for a cloth cutter which uses two grinding belts. A supporting mechanism holds the two grinding belts which traverses the length of the reciprocating knife edge thereby sharpening the knife. F. G. Clark was also issued another U.S. Pat. No. 2,829,474 on Apr. 8, 1958 which describes an improvement to the 2,537,208 patent for controlling the flexible grinding belts. Both of these patents use a drive shaft having peripheral left and right hand threads cut therein for achieving the traverse movements of the grinding mechanism. In both of these patents, the drive shaft rotates within a stationary nut such that the drive shaft moves in a desired direction. To reverse the direction of the traverse action, the drive shaft may change directions itself, or a second nut may be engaged which follows the opposite threads to move the screw shaft back to its original position.

U. S. Pat. No. 3,233,371 issued to Robert Stucker on Feb. 8, 1966 discloses a grinding mechanism which uses two rotating wheels for sharpening the reciprocating blade. To achieve the traversing action of the grinding mechanism, this patent also uses a drive shaft having peripheral left hand and right hand square threads cut therein. A particular embodiment has the left hand thread connected with the right hand thread at the top and at the bottom of the shaft such that the two threads are continuous. This patent also includes an improvement over the previously discussed patents in that, although, the drive shaft continues to rotate as was discussed heretofore with respect to the 2,537,208 and the 2,829,474 patents, the drive shaft itself does not make any traverse action. Instead, a nut or guide means which is connected to the grinding apparatus follows the thread, and is driven with the selected traverse movement by the rotating drive shaft. In addition, the guide means is arranged such that when it reaches the bottom of the threads in its downward motion, it is connected or switched to the thread cut in the opposite direction. This moves the guide back to its original starting position at the top of the threaded guide shaft.

Thus, it can be seen that in the three patents discussed heretofore, a drive shaft having left hand and right hand peripheral threads cut therein is used in two different manners to achieve the traverse action. It will be appreciated, however, that the traverse motion of the grinding apparatus proceeds at substantially a constant speed in both the upward and downward direction. However, it will also be appreciated that the reciprocating knife blade which travels at a much higher speed comes to a complete stop at the bottom and top of its travel before it changes directions. Therefore, the speed of the reciprocating knife blade is not the same at the top and bottom of its travel as it is in the middle point of its travel. In fact, the driving mechanism of most such cloth cutting machines is such that the speed of the reciprocating knife blades varies in a sinusodial manner. That is, it moves fastest at its midpoint and then will start slowing down as it approaches the two end points of its travel. It will further be appreciated, that the typical cutting machine can be used to cut various thicknesses or layers of cloth. Consequently, for thinner or a smaller number of layers of cloth the bottom portion of the blade is used, whereas for thicker layers of cloth the bottom portion as well as upper portions of the knife blade is used. It will therefore be appreciated that the bottom portion of the blade will typically be used more often and receive more wear than the remainder portions of the blade. Further, to assure that the very tip of the reciprocating cutting blade is itself sharpened the grinding mechanism must move or transverse to a point beyond the end of the blade when the blade is in the retracted position of its reciprocating motion. That is, the grinding mechanism will traverse completely past the end of the blade before starting back on its return path. Consequently, the tip of the blade will not make contact with the traversing grinding apparatus as continuously as the midportions of the cutting blade. Thus, if the traverse motion is at a constant velocity then there will be as much contact time with the grinding apparatus at the tip of the blade as at the remaining portions of the blade. Therefore, the tip of the blade may not be sharpened to as keen an edge as the midportions. For the various reasons discussed above, it will be appreciated that to assure that the blade is properly sharpened over its full length, it may be necessary to provide a longer contact period for the end portion or tip of the blade which receives more wear than the remaining portions. To accomplish this, it would be desirable that the traverse action of the grinding mechanism vary in speed such that a longer period of time is available for grinding the bottom end portion or tip of the reciprocating blade.

Therefore, it is an object of the present invention to provide grinding apparatus having a transverse action with a variable speed such that the end portion of the reciprocating blade may receive at least as much contact time with the grinding apparatus as middle portions of a blade.

Still another object of this invention is to provide sharpening apparatus having a variable traverse speed for a reciprocating blade, which apparatus can be used and operated with existing cutting machines.

BRIEF SUMMARY OF THE INVENTION

Other objects and advantages will in part be obvious, and will in part appear hereinafter, and will be accomplished by the present invention which provides apparatus for providing a variable traversing speed of a grinding means used to sharpen the reciprocating knife edge of a cloth cutting machine. The apparatus comprises a driven grinding means for contacting an edge of the reciprocating blade to be sharpened. A movable carriage for supporting and moving the driven grinding means along the edge to be sharpened is also provided. The movable carriage is moved in the proper direction by means of a traversing means or mechanism which includes a guide means for following peripheral left hand and right hand threads cut along the length of a drive shaft having first and further sections. The left hand and right hand peripheral threads have a first selected pitch along the first section of the shaft and a second or different pitch from the first pitch along the second section of the drive shaft such that the driven grinding means moves along the selected portion of the reciprocating knife edge at different speeds depending upon the pitch of the threads. In a preferred embodiment, the left and right hand peripheral threads have a greater pitch in the first or topmost portion of the drive shaft and a lesser pitch in the bottommost portion such that the grinding means moves along the lowermost portion of the reciprocating blade for a longer period of time than during the uppermost portion of the reciprocating blade. However, it will also be appreciated that the peripheral threads could be cut at three or more different pitches, or could in fact very continuously with a sinusodial variation from the top to bottom of the threads cut into the drive shaft.

BRIEF DESCRIPTION OF THE DRAWINGS

The above mentioned features of the present invention will be more clearly understood from the consideration of the following descriptions in connection with the accompanying drawings in which.

DESCRIPTION OF THE PREFERRED EMBODIMENTS

Figure 1:
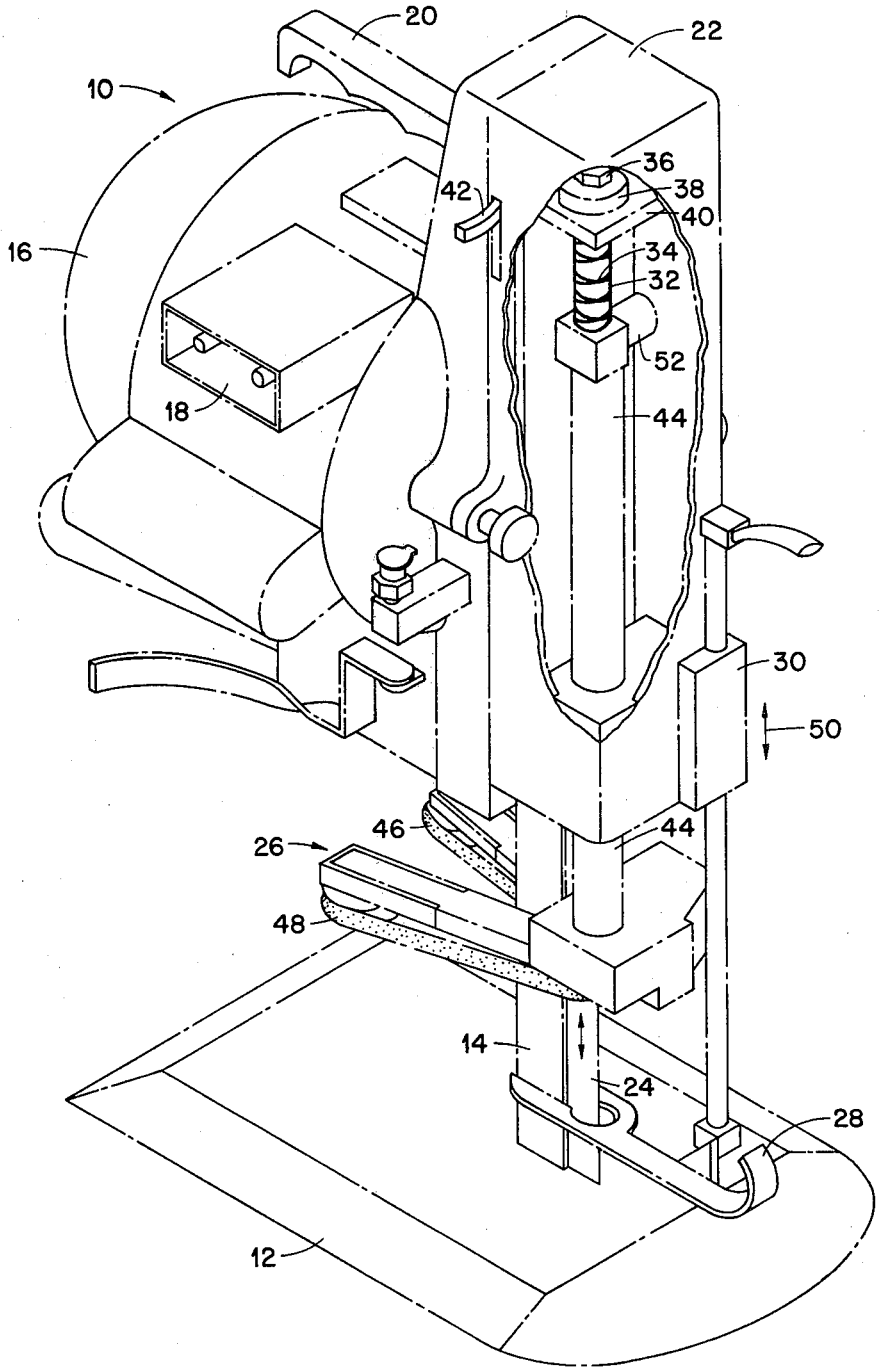
FIG. 1 is a pictorial view of the cloth cutting machine having a cut away portion to show the traverse drive of the grinding mechanism in its resting position along the threaded drive shaft.

Referring now to FIG. 1, there is shown generally at 10 a common cloth cutting device typically used for cutting various layers of cloth or sheets of material. The device includes a support base 12 to which there is attached a vertical standard 14 which in turn supports a housing 16. Housing 16 typically contains an electrical motor which will receive its electrical power by means of a connector plug 18. Also included is a handle 20 for guiding the machine as it cuts through the multiple layers of cloth. Attached to the housing 16, and driven by the electrical motor contained therein, is a drive housing 22 which contains the drive mechanism (not shown) for driving the reciprocating blade 24, the mechanism for driving the grinding apparatus 26 and for achieving the traversal motion of grinding apparatus 26 back and forth across the length of reciprocating blade 24. In addition, there is a pressure foot 28 which holds the top layer of cloth firmly down against the remaining multiple layers. This pressure foot is maintained in position by the lifting mechanism 30 attached to drive housing 22. To drive the grinding mechanism 26 and to provide the traverse action, there is shown a portion of a drive shaft 32 having left hand and right hand threads 34 cut therein. Drive shaft 32 is supported such that it can rotate, but not move in an axial direction within the housing 22 by means of a lock nut 36, washer 38, and a support member 40. Although the lock-in mechanism is not shown and is not a part of this invention, when sharpening of the reciprocating blade 24 is desired, simply pressing of trigger 42 will initiate mechanism which engages drive gearing attched to drive shaft 32 such that drive shaft 32 is rotated around its longitudinal axis by the drive gearing. Rotation of drive shaft 32 provides drive power through tubular support member 44 to grinding belts 46 and 48 of grinding apparatus 26. As shown, tubular member 44 attaches to a back portion of grinding apparatus 26, and is free to move up and down as is indicated by arrow 50. Also as will be discussed in detail hereinafter, drive shaft 32 rotates within tubular support member 44 to provide the traverse motion of the grinding apparatus 26 and the power to the grinding belts 46 and 48. Also shown, and as will be discussed in detail hereinafter, tubular support member 44 also includes at its topmost portion a guide means 52 which follows the peripheral left and right hand threads 34 cut in drive shaft 32.

Figure 2:
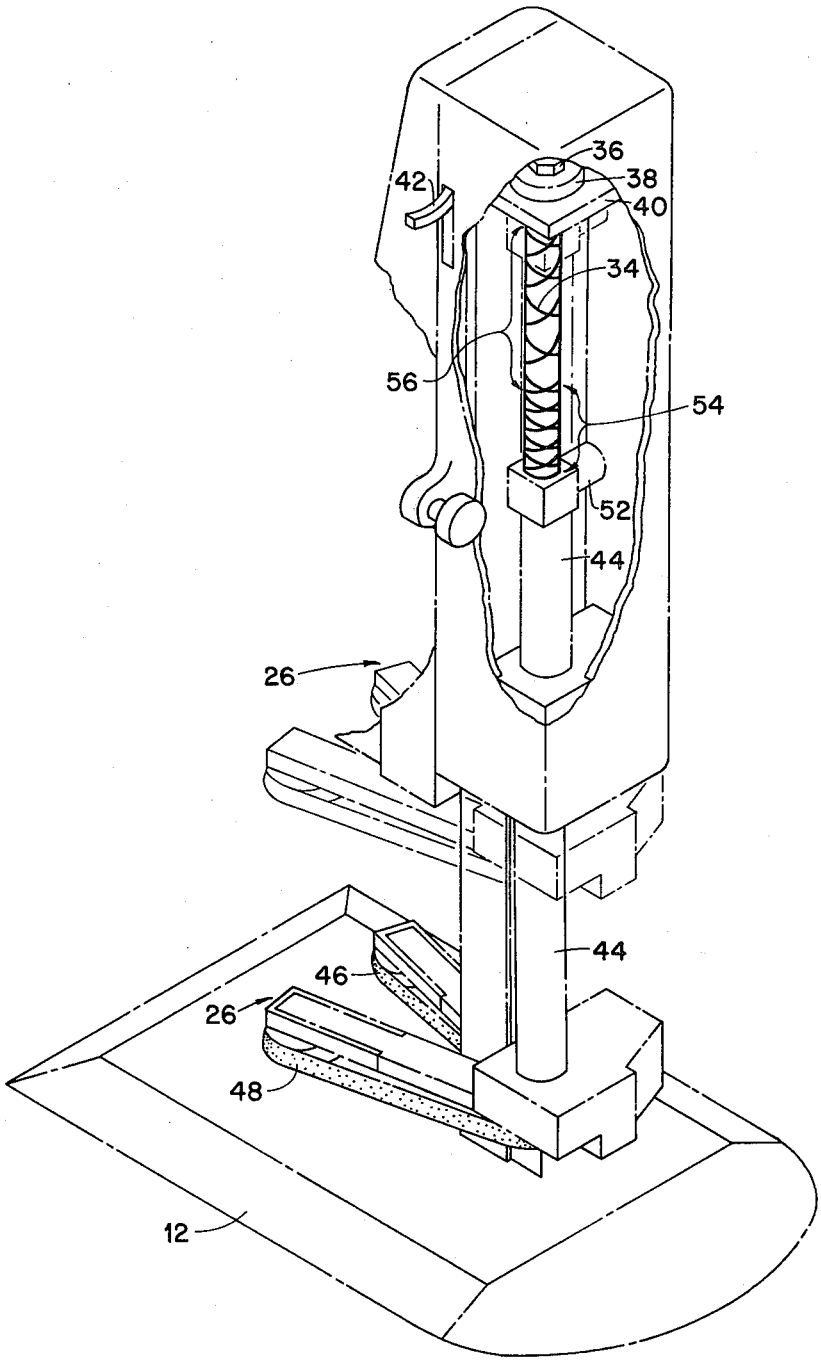
FIG. 2 is a cut away view showing the traversing grinding mechanism in a lowermost position, and showing the rotating drive shaft with two selected pitches.

Referring now to FIG. 2, there is shown the drive mechanism housing 22, and the variable speed grinding apparatus of this invention in operation. It will be appreciated that components shown in FIG. 2 which are identical to those discussed heretofore with respect to FIG. 1 will retain the same reference numbers. As shown, the grinding apparatus 26 has been moved to the bottommost portion of its travel such that it is in position to grind the bottommost portion of blade 24. As can be seen, the grinding apparatus 26 has moved from the top position indicated by phantom lines. As can further be seen, the drive shaft 32 has remained in its axial position whereas the tubular support member 44 has moved in a downward direction, and has carried the grinding apparatus 26 to the lowermost position. In this particular figure, it can be seen that the pitch of peripheral threads 34 of the uppermost portion of the drive shaft 32 is greater than the threads on the lowermost portion 54 of the drive shaft 32 as will be discussed in detail hereinafter. It is this change in the pitch of the left hand and right hand peripheral threads that provides a variable traverse speed of grinding apparatus 26.

Figure 3:
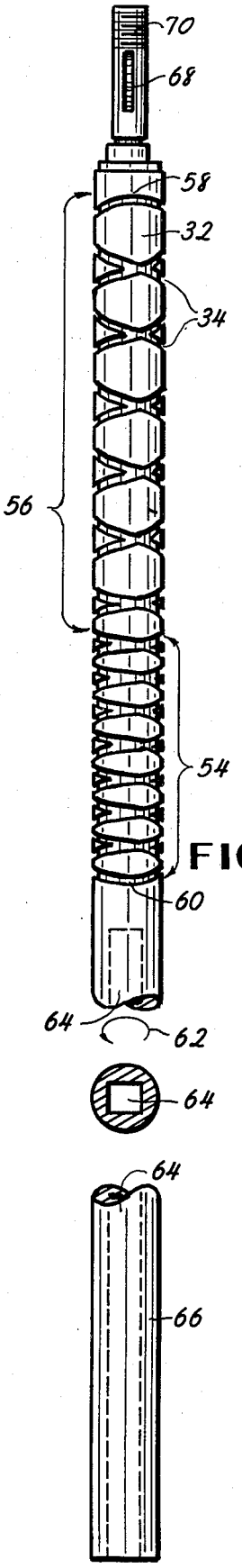
FIG. 3 is an elevation view of the drive shaft with the left and right hand peripheral threads joined at both the top and bottom to provide a continuous or endless thread.

Referring now to FIG. 3 there is shown an elevation view of the drive shaft 32 having threads 34 on an uppermost portion 56 of drive shaft 32 with a first pitch and threads 34 on lowermost portion 54 with a second and lesser pitch. Also as is shown, the left hand threads and right hand threads are connected with a top connecting thread 58. Likewise, the left hand threads and right hand threads are connected at the bottommost portion by connecting thread 60. Thus, the threads are "endless" in that if it is assumed that the drive shaft 32 rotates in the direction indicated by arrow 62, a guide means 52 which moves in both left and right hand threads will first follow the right hand threads to the bottommost portion 54 of the drive shaft 32 to the connecting thread 60 and then follow the left hand threads to the top of drive shaft 32 to the connecting thread 58 at the topmost portion 56. If the rotation of the drive shaft is continuous, then the guide member will continuously move in an up and down direction first following the right hand threads to the bottom portion 54 of the threaded shaft and then follow the left handed threads again to the uppermost portion 56 of the shaft. This sequence would repeat so long as shaft 32 rotated. In addition to the threads, shaft 32 also includes an elongated opening or bore 64 in the unthreaded portion 66 of drive shaft 32. Although the exact cross-section of the opening is not critical, for purposes of operation it should be symetrical, non-circular and concentric with the longitudinal axis of drive shaft 32. Also, as shown, drive shaft 32 may typically include a key way 68 to receive a woodruff key (not shown) and a threaded portion 70 for receiving nut 36 discussed heretofore. Key way 68 for receiving a woodruff key provides means by which a spur gear or other gear driving mechanism can be attached to drive shaft 32 to provide the rotational motion as indicated by arrow 62.

Figure 4:
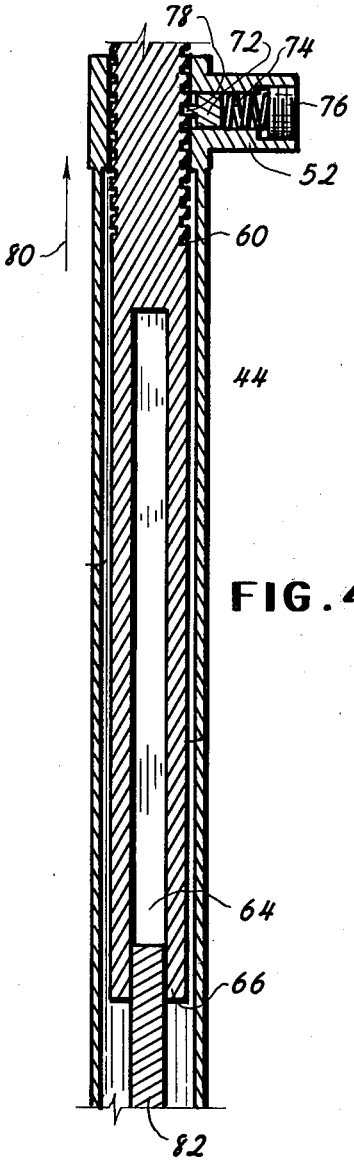
FIG. 4 is a cross-sectional view of the bottommost portion of the drive shaft of FIG. 3 along with a cooperating drive member having a guide finger for following peripheral threads on the drive shaft.

Referring now to FIG. 4, there is shown in further detail the traversing mechanism of the present invention. As shown, threaded drive shaft 32 is typically contained in tubular support member 44. Attached to the topmost portion of tubular member 44 is the guide mechanism 52. As shown, guide mechanism 52 includes a guide follower 72 which follows the left and right hand peripheral threads 34 cut in drive shaft 32. A compression spring 74 held in place by a set screw 76 maintains the finger 78 of guide 72 within the left and right hand peripheral threads. Thus, it can be seen that rotation of drive shaft 32 will cause the tip portion or finger 78 of guide 72 to ride within the left and right hand peripheral thread. As shown in FIG. 4, tubular supporting member 44 of the traversing mechanism has moved down to a lowermost portion of the drive shaft 32 and is riding in threads 34 which have a low pitch. As was discussed with respect to FIG. 3, when finger 78 is in the connecting thread 60 of threads 34, continual rotation of the drive shaft 32 will cause guide means 52 to switch to the left hand threads and move in an upright direction as indicated by arrow 80.

The power for driving grinding apparatus 26 is achieved by drive means 82 having a cross-section the same as aperture 64 which is suitable for being received by aperture 64 of drive shaft 32. Drive means 82 is also selected so that it slides easily within aperture 64. It will further be appreciated that drive means 82 also rotates within tubular member 44, moves longitudinal with respect to drive shaft 32, but does not experience any longitudinal or axial movement with respect to tubular support 44, as these two parts move together in an axial direction. Thus, when tubular support 44 starts moving in an upward direction as indicated by arrow 80, drive means 82 will also move up into the aperture 66 of drive shaft 32. Therefore, it will be appreciated that non-circular drive means 82 will be rotated by drive shaft 32 but is free to slide within aperture 64 of drive shaft 32 in response to the traverse action of tubular support 44.

Referring again to FIG. 3, and FIG. 4 in combination, it will be appreciated that because of the different pitch in the lower section 54 of drive shaft 32, the traverse action along the axial or longitudinal axis of drive shaft 32 by tubular support means 44 will be much slower as finger 78 of the guide means 52 follows the low pitch threads. Consequently, a substantially greater amount of contact time will be available for the grinding mechanism 26 of FIG. 1 to remain in contact with the reciprocating blade 24. The additional contact time of the grinding apparatus allows more even grinding and sharpening of the blade and allows additional grinding time to be available at the lowermost portion of the blade for sharpening. It is the lowermost portion for the blade tip which is usually dulled. It will be appreciated that although only two different pitches of left and right hands threads are shown in FIG. 3, it would also be possible to include three different pitches, or it would be possible to include left hand and right hand threads with a continuously variable pitch over the entire threaded length of drive shaft 32. By selectively varying the pitch of the peripheral threads 34 the speed of the grinding apparatus traversing the reciprocating knife 74 can be varied as desired. It will also be appreciated, of course, that although shaft 32 having variable pitch threads 34 has been discussed with respect to cloth cutting machine, such a shaft may be used to provide a variable speed drive to other types of machines.

Thus, although the present invention has been described with respect to specific apparatus for providing sharpening apparatus, it is not intended that such specific references be considered limitations upon the scope of the invention except insofar as is set forth in the following claims.

I claim:

1. Sharpening mechanism for moving at a variable speed along the length of the edge of a recipicating knife of a cutting mechanism comprising:

driving means;

grinding means driven by said driving means for contacting an edge on said knife to be sharpened;

a movable carriage for supporting and moving said grinding means along said edge of said recipicating knife;

traversing mechanism for moving said movable carriage, said traversing mechanism including a drive shaft rotated by said driving means and having a first and further portion and right hand and left hand peripheral threads cut therein, a guide means for following said peripheral threads cut in said drive shaft, and a carrier member connecting said guide means and said movable carriage, said right and left hand peripheral threads having a first selected pitch along said first section of said drive shaft and a pitch different from said first selected pitch along said second portion of said drive shaft such that said driven grinding means is moved along selected portions of said recipicating knife edge at selected speeds.

2. The apparatus of claim 1 and further including a middle portion of said drive shaft wherein said right hand and left hand peripheral threads have a second selected pitch, said second selected pitch being different from said first selected pitch along said first portion of said drive shaft, and said pitch along said second portion.

3. The apparatus of claim 1 wherein said drive shaft has a first and further end and said peripheral right hand and left hand threads extend to said first and further ends, and wherein said right hand thread connects with said left hand threads at said first and further ends such that when said drive shaft rotates in a selected direction, said guide means following said peripheral threads will follow an endless path along a selected one of said right hand and left hand threads to said first end, and then follow the other of said right hand and left hand threads to said further end.

4. The apparatus of claim 3 further including a middle portion of said drive shaft wherein said left hand and right hand peripheral threads have a second selected pitch, said second selected pitch being different from said first selected pitch along said first portion of said drive shaft and said pitch along said second portion.

5. The apparatus of claim 1 wherein said pitch of said left and right hand peripheral threads along said second portion constantly varies.

6. The apparatus of claim 5 wherein said continuous variation is sinusodial.

7. The apparatus of claim 3 wherein the pitch of said left and right hand peripheral threads along said second portion constantly varies.

8. The apparatus of claim 7 wherein said continuous variation is sinusodial.

9. The apparatus of claim 1 wherein said cutting mechanism is a cloth cutting mechanism.

* * * * *